United States Patent [19]

Grosser

[11] 4,429,616

[45] Feb. 7, 1984

[54] APPARATUS FOR TRANSPORTING AMMUNITION TO A TOP-MOUNTED GUN

[75] Inventor: Heinrich Grosser, Vellmar, Fed. Rep. of Germany

[73] Assignee: Thyssen Industrie AG Henschel, Kassel, Fed. Rep. of Germany

[21] Appl. No.: 340,713

[22] Filed: Jan. 19, 1982

Related U.S. Application Data

[63] Continuation of Ser. No. 68,868, Aug. 22, 1979, abandoned.

[30] Foreign Application Priority Data

Aug. 26, 1978 [DE] Fed. Rep. of Germany ..... 2837303

[51] Int. Cl.[3] ..... F41H 7/06

[52] U.S. Cl. ..... 89/36 K; 89/46; 89/34

[58] Field of Search ..... 89/33 A, 33 B, 34, 36 H, 89/36 K, 40 B, 45, 46, 47, 1.801, 1.802, 1.804, 1.805

[56] References Cited

U.S. PATENT DOCUMENTS

| | | | |
|---|---|---|---|
| 1,464,171 | 8/1923 | Dawson et al. | 89/45 |
| 2,785,607 | 3/1957 | Henstrom et al. | 89/36 H |
| 4,092,901 | 6/1978 | Gustavsson et al. | 89/46 |

FOREIGN PATENT DOCUMENTS

| | | | |
|---|---|---|---|
| 1428746 | 10/1973 | Fed. Rep. of Germany | 89/40 B |
| 2501426 | 7/1975 | Fed. Rep. of Germany | 89/47 |

*Primary Examiner*—Stephen C. Bentley

*Attorney, Agent, or Firm*—Becker & Becker, Inc.

[57] ABSTRACT

A device for transporting ammunition, especially cartridges and the like, from a fixed magazine to a top-mounted gun is disclosed. The ammunition is brought to a charging position, in which it is substantially coaxial to the axis of bore of the gun, by utilization of a lift mechanism which is swingable about a horizontal axis by being pivotally mounted at one end to a part which is rotatable about the lateral alignment axis of the gun, while the other end of the lift mechanism includes a cartridge holder. The gun itself is adjustable as to elevation and is operatively connectible to an armored dome of a protective armor, with the dome being adapted to rotate about its vertical axis. The ammunition is stored parallel to one another and to the axis of bore of the gun in the fixed magazine beneath the protective armor. The device includes a stand-by magazine locatable between the fixed magazine and the gun, with the stand-by magazine being connectible to the dome at the rear thereof. The stand-by magazine includes a first section and a second section arranged alongside one another at a predetermined distance, each section being of somewhat shallow height, adapted to receive a layer of ammunition, and equipped with an endless conveyor operable in clockwise and counterclockwise direction. The space between the two sections of the stand-by magazine is adapted to receive ammunition, and the cartridge holder of the lift mechanism is adapted to be lowered into the space for receiving the ammunition. The cartridge holder is movable either in the vertical plane of the axis of bore of the gun or transverse thereto.

11 Claims, 5 Drawing Figures

ACTUATOR

APPARATUS FOR TRANSPORTING AMMUNITION TO A TOP-MOUNTED GUN

This is a continuation of co-pending application Ser. No. 068,868-Grosser filed Aug. 22, 1979, now abandoned.

The present invention relates to a device for transporting ammunition, e.g. cartridges and the like. More particularly, the invention relates to a device for transporting ammunition to a top-mounted gun. The gun is adjustable as to elevation and operatively connectible to an armored dome of a protective armor. The armored dome is adapted to rotate about its vertical axis, with the ammunition being stored parallel to one another and to the axis of bore of said gun in a fixed magazine arranged beneath the protective armor.

In a known device of this type, the lift mechanism is operatively connected to a ring which is concentric to the rotatable tank dome and freely rotatable relative thereto. The magazine is supported to be transverse to the longitudinal axis of the armored vehicle and, for the transfer of ammunition to the loading pendulum, comprises a channel and an inserting mechanism which extends beyond its rear wall. It is detrimental in this device that the ring with the loading pendulum secured thereto has to be rotated out of the loading position into the charging position, or vice versa, in conformity with the angular positioning of the gun therewith, more or less, for reloading whereby the transport of ammunition is time consuming and, accordingly, the rate of firing is not sufficient.

It is also known to arrange an ammunition magazine in a tank tower behind a gun with the tank tower being rotatable about a vertical axis, whereby the magazine only follows the lateral movement of the gun. The ammunition in this device is arranged in the magazine in two horizontal planes, one above the other. The ammunition is moved by means of an endless conveyor chain, always in the same position, in the upper and lower tower. The transport of ammunition from the magazine to the gun is carried out by means of a loading crane which is arranged below and behind the breech mechanism of the gun. The requirement to reduce the overall height of the vehicle serving as the weapon carrier, so as to present a limited target, is not fully attained with this arrangement.

It is, accordingly, an object of the present invention to provide a device for transporting ammunition with which part of the ammunition can be directly fed to the gun, independently of particular angular attitudes during the lateral alignment movement thereof, to assure that a high firing rate is attainable.

It is furthermore an object of the invention that the magazine for holding the ammunition ready for charging has low height and can contain different types of ammunition.

These objects and other objects and advantages of the invention will appear more clearly from the following specification in connection with the accompanying drawings, in which.

The device for transporting ammunition according to the invention is characterized primarily therein that between the gun and the fixed magazine also referred to as the main magazine arranged beneath the protective armor, there is arranged a stand-by magazine, also referred to as the intermediate magazine. This stand-by magazine is arranged at the rear of the rotatable tank dome to form the rear thereof. The stand-by magazine comprises two generally flat, sections spaced apart from one another for the reception of a layer of ammunition. Each section is provided with an endless conveyor adapted to move, respectively, either in clockwise direction or in counterclockwise direction. Between the magazine sections there is provided a space or shaft into which the cartridge holder of the lifting mechanism can be lowered, in the rest position and for loading. The cartridge holder, furthermore, is movable either in the vertical plane of the axis of the gun or transverse thereto.

In accordance with one preferred embodiment of the invention, the lift mechanism includes a bent arm which is operatively connected with a bifurcated end to the two trunnions of the gun. At the other end of the lift mechanism there is provided the swingable or pivotally movable cartridge holder.

In accordance with another embodiment of the invention, the lift mechanism includes two straight arms arranged along a longitudinal side of the cartridge holder, one beside the other. The arms are arranged such that the one end of each is swingable or pivotally movable about a pivot shaft belonging therewith. The pivot shafts are arranged in the space between the magazine sections and extend transverse to the axis of bore of the gun. The respective other ends of the arms are pivotally movable about short pivot shafts secured to the cartridge holder to extend transverse to the axis of bore of the gun.

In accordance with a further preferred embodiment of the invention, the lift mechanism includes two straight swing or pivot arms which are arranged one behind the other, when viewed in the longitudinal direction of the cartridge holder. The swing or pivot arms are operatively connected to pivot shafts or pins which, respectively, extend parallel to the axis of bore of the gun in the space between the intermediate magazine sections and on the cartridge holder.

Figure 1:
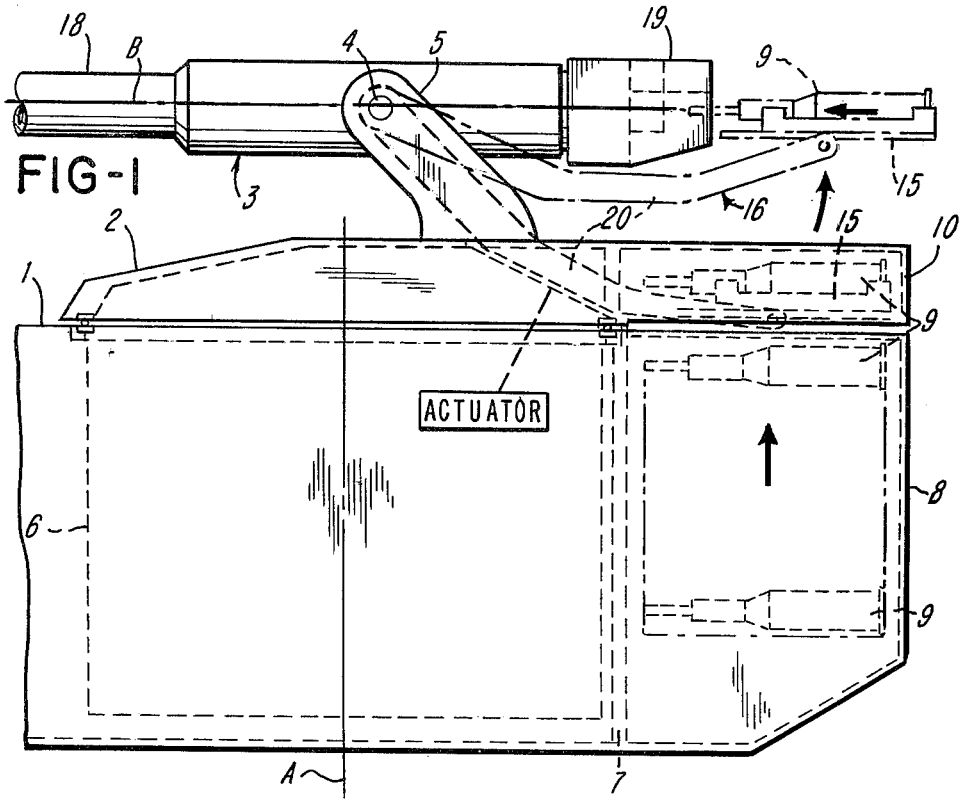
FIG. 1 shows a side elevational view of an embodiment of the invention, wherein the lift mechanism is pivotable about the central axis of the trunnions of the gun, with the lift mechanism being shown in two different positions.

Referring now particularly to the drawings in detail, there is diagrammatically indicated in FIG. 1 a protective armor 1 (vehicle or bunker) on which there is provided a rotatable armor or tank dome 2 arranged so as to be rotatable about a vertical axis A. A gun 3 is mounted on dome 2 by means of trunnions 4, 4' and side plates 5, 5'. As indicated in FIG. 1, the gun is at elevation zero.

Figure 5:
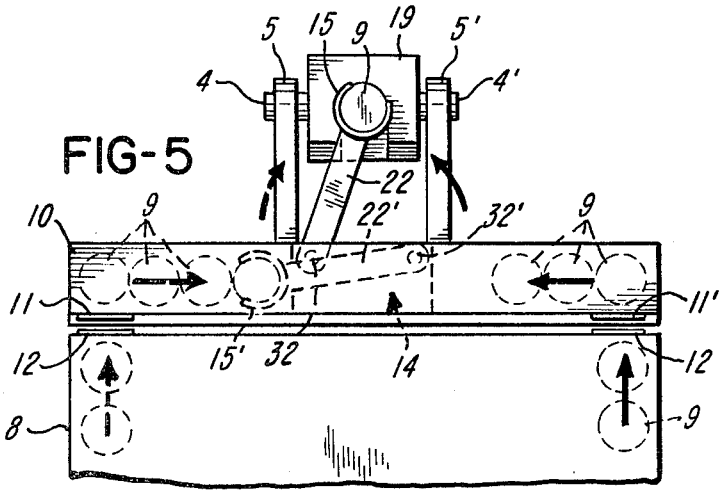
FIG. 5 is an end view in the direction of arrow X in FIG. 4.

Beneath the dome 2 there is provided a personnel compartment 6 having a vertical axis which coincides with the lateral adjustment axis of the gun. Separate from the gun 3, also within the protective armor, but alongside the personnel compartment 6, there is arranged an ammunition magazine 8, also referred to as the main magazine. A gas- and explosion-proof partition 7 is provided between the personnel compartment 6 and the main magazine 8. The cartridges 9 are arranged in the main magazine 8, with their longitudinal axes being directed toward the personnel compartment 6. The cartridges 9 are arranged to extend alongside one another and in tiers above one another. For each type of ammunition in the magazine 8 there are provided a known endless revolving conveyor and an inserting device, all not shown. These serve to successively transport cartridges 9 from the main magazine 8 into a stand-by magazine or intermediate magazine 10. The stand-by magazine 10 is arranged above magazine 8 and serves as the rear of the rotatable dome 2. Openings are required for replenishing ammunition for the stand-by magazine 10, in the top wall of main magazine 8 and in the bottom wall of the stand-by magazine 10; the openings can be closed by means of swingable or pivotable covers 11, 11' and 12, 12' (FIG. 5). These covers are actuated at these locations in accordance with the movement of the inserting device belonging therewith. The covers prevent entry of foreign matter, fire, and the like, into the magazines 8 and 10, respectively.

Figure 2:
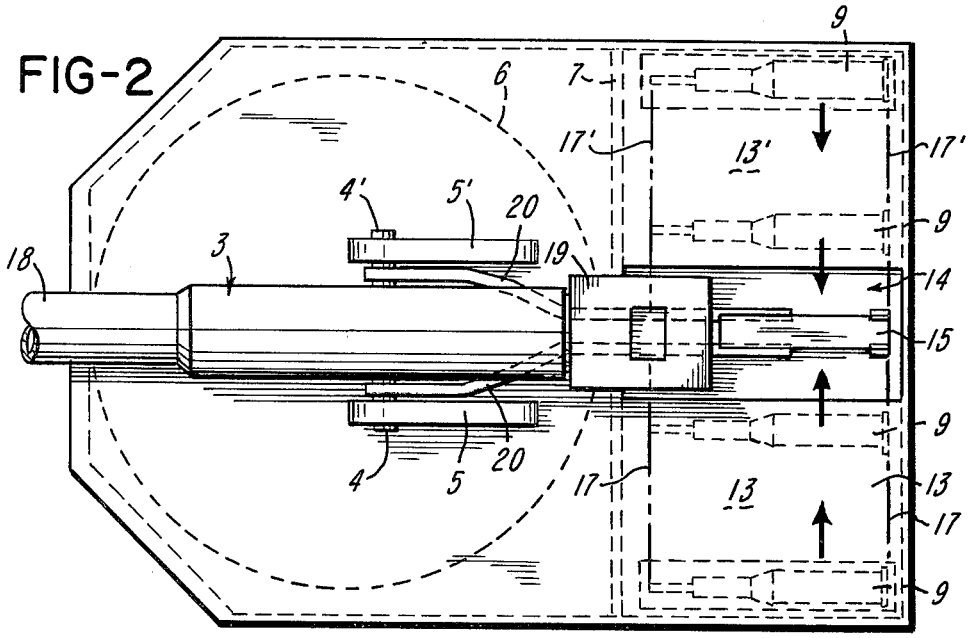
FIG. 2 is a top plan view according to FIG. 1 in which only those parts are indicated which are necessary for the understanding of the invention.

As is particularly evident from FIG. 2, the stand-by magazine 10 comprises two sections 13 and 13', one arranged alongside the other at a predetermined distance, with these sections 13 and 13' being separated by a space or shaft 14. A cartridge holder 15 of a swingable or pivotally mounted lifting mechanism 16 can extend into the space 14, in the rest position and during loading. Each of the magazine sections 13 and 13' is provided with an endless conveyor 17, 17', respectively, for transporting the cartridges 9 to the space or well 14, i.e. in the direction transverse to the axis of bore of the gun barrel 18 of gun 3. From the space 14, the cartridges are eventually brought to the cartridge holder 15 of the lifting mechanism 16 by way of a transfer device, not shown, and the cartridges are then lifted with the lift mechanism 16 to the gun 3. As is readily seen in FIG. 2, the rounds of ammunition 9 are covered by armour plate which fits over the magazine sections 13 and 13'. There is a gap in the armour plate which is aligned with the space 14 so that the shells can be lifted from the space 14 to the breach 19 of the gun, as is seen in FIG. 1.

The cartridge holder 15 is provided with clamping claws and further comprises an integrated ram member, both not shown. One of the two endless conveyors 17, 17 in the stand-by magazine 10 rotates in clockwise direction, and the other rotates in counterclockwise direction. Between the two magazine sections 13 and 13' of the stand-by magazine 10, the space or shaft 14 is provided with covers, not shown and known per se. These covers provide—on lifting of the cartridge holder 15 from the rest position and/or loading position, and for lowering of the cartridge holder 15 into the shaft. The covers permit opening of the space 14 only for a short period of time so that also here entry of foreign materials, fire, and the like, is prevented. As soon as the cartridge holder 15 attains the position in which the longitudinal axis of a cartridge 9, present in the clamping claw, is in line with the axis of bore of gun barrel 18, and is then in contact with the abutment (not further indicated) at the breech plate 19 of the gun 3, the clamping claws are opened; then, the released cartridge is moved by the integrated ram of the cartridge holder 15 into the breech plate 19 of the gun 3. Subsequently, the ram is moved to its starting position and the lift mechanism 16 associated with the cartridge holder 15 is moved in downward direction. The movements of the lift mechanism 16 from the rest position and/or loading position into the charging postion, or vice versa, are attained by means of a control device and a lift/cylinder unit or the like, not shown in detail and indicated by the designation "ACTUATOR" in FIG. 1.

Since the automatic transport process is subject to control by a sequential circuit, not shown, which is not part of the present invention, this transport process is not further described herein.

In the embodiment according to FIGS. 1 and 2, the lift mechanism 16 arranged between the stand-by magazine 10 and the gun 3 includes a bent swing or pivot arm 20 which is bifurcated, as indicated in the plan view in FIG. 2, at the end farthest from the swingable cartridge holder 15. The swing or pivot arm 20 is operatively connected to the trunnions 4 and 4' of the gun 3, to be movable in the vertical plane of the axis of bore B of gun barrel 18.

Figure 3:
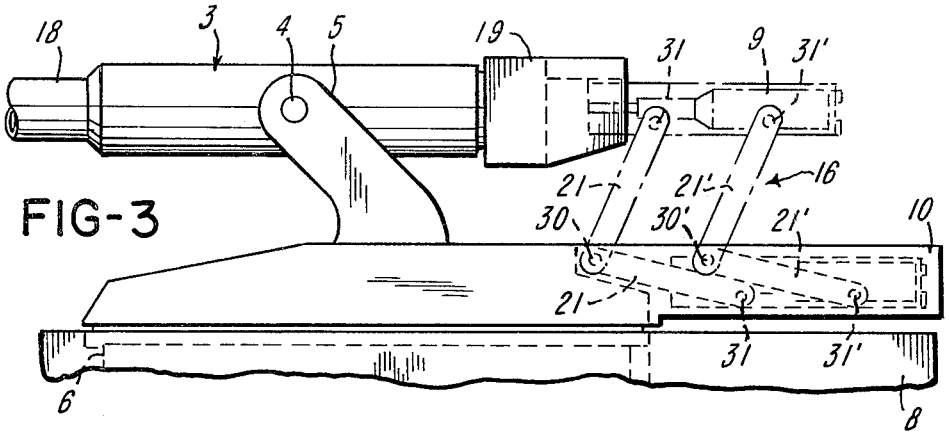
FIG. 3 shows a view similar to FIG. 1 of another embodiment of the invention.

The embodiment according to FIG. 3 includes two generally straight swing or pivot arms 21 and 21', instead of a bent swing or pivot arm as was indicated in FIG. 1. The arms 21 and 21' form parallel linkages which collapse for picking up rounds 9 from the space 14 and extend for positioning the rounds 9 to load the rounds into the breach 19 of the gun 3. These arms 21 and 21' are arranged alongside one longitudinal side of the cartridge holder 15, and are swingable or pivotable about pivot shafts 30 and 30' extending transverse to the axis of bore B of gun barrel 18 in the space 14 between the stand-by magazine sections 13 and 13'. The respective other ends of arms 21 and 21' are swingable or pivotable about pivot shafts 31 and 31' which also extend at right angles to the axis of bore B of the gun barrel 18, and which are secured to the cartridge holder 15. The arms 21 and 21' and the horizontal lines connecting the two pairs of pivot shafts form a parallelogram, with the sides formed by the swing or pivot arms being movable. Due to the location of the pivot shafts 30 and 30' in the space 14 and the pivot shafts 31 and 31' on the cartridge holder 15, the two swing or pivot arms 21 and 21' are only movable parallel to the vertical plane of the axis of bore B of the gun barrel 18. The cartridge holder 15, during the upward and downward movement, is maintained in a position parallel to the axis of bore B of the gun barrel 18.

Figure 4:
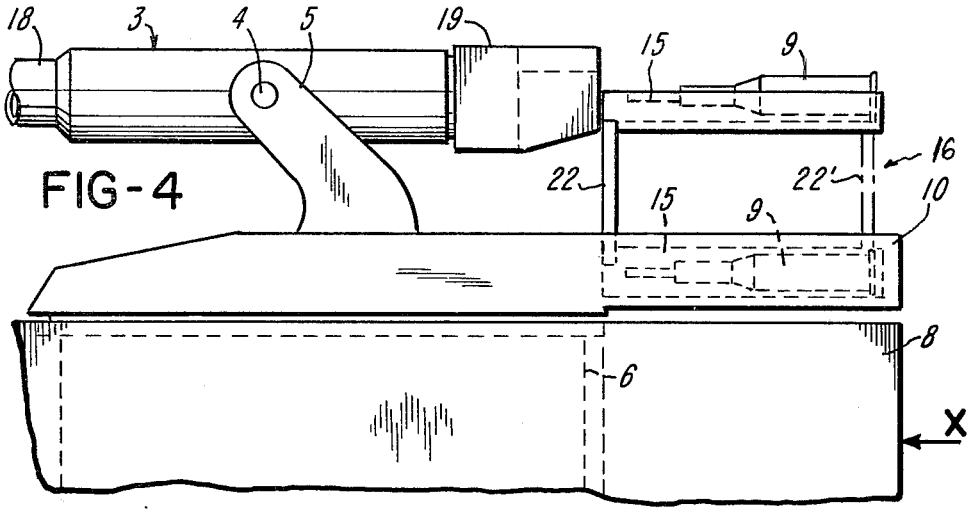
FIG. 4 shows a further embodiment of the invention in a view similar to that of FIG. 1.

In the embodiment shown in FIGS. 4 and 5, the lift mechanism is provided by two straight swing or pivot arms 22 and 22' which, according to the side elevational view of FIG. 4, are arranged at a distance from one another and in the direction indicated by arrow X, i.e. in FIG. 5, being arranged behind one another. They are operatively connected to pivot shafts 32 and 32' which extend parallel to the axis of bore B of gun barrel 18. These pivot shafts 32 and 32' are arranged to extend in the space 14 of the stand-by magazine 10 and at the cartridge holder 15, respectively. With this embodiment it will be possible to utilize two lift devices, instead of only one, which operate counter-currently and alternatingly, transverse to the axis of bore B of gun barrel 18. Since the lifting arms 20 and 22' are not attached to the gun, they are operatively independent from the elevation of the gun.

One of the advantages provided by the invention resides therein that the two horizontal conveying planes in the stand-by magazine 10 are arranged immediately adjacent to one another, whereby a particularly low height of the system is obtained. This, furthermore, when arranging different types of ammunition permits holding to a minimum dimension that height of the armored dome 2 which extends above the protective armor 1.

The present invention is, of course, in no way restricted to the specific disclosure of the specification and drawings, but also encompasses any modifications within the scope of the appended claims.

I claim:

1. Apparatus for storing rounds of ammunition and loading the rounds in a gun having a breech and a barrel wherein the gun is mounted on and above an armored turret for rotation about a horizontal axis with respect thereto to elevate the barrel and wherein the turret is mounted on an armored enclosure for rotation about a vertical axis with respect thereto to swivel the barrel with respect to the armored enclosure, the apparatus comprising:

a main magazine located within the armored enclosure for storing the rounds of ammunition in parallel vertical columns within the armored enclosure;

a standby magazine positioned in the turret behind and beneath the breech of the gun, the standby magazine being operatively independent of the elevation of the gun and being rotatable in and out of alignment with the main magazine; the standby magazine having first and second sections extending parallel to said horizontal axis, the first and second sections being covered with armor and being separated by a space aligned with a gap in the armor plate through which gap the rounds are delivered to the breech of the gun, and means included in the first and second sections for moving the rounds horizontally to the space so that the rounds may be lifted through the gap in the armor plate to the breech of the gun;

lifting means mounted on said turret and movable operatively independent of the elevation of said gun, means for moving the lifting means vertically between a first position within the space for receiving rounds from the standby magazine and a second position behind the breech of the gun for charging the gun with the round, and means for transferring rounds from the main magazine to the standby magazine when the turret is rotated to position the standby magazine in alignment with the main magazine.

2. The apparatus of claim 1 wherein the lifting means includes an ammunition round holder for aligning individual rounds with the axis of the gun breech; an arm connected to the ammunition round holder for lifting the holder, and means for pivoting the arm about an axis which is horizontal with respect to the turret and independent of the elevation of the gun.

3. The apparatus of claim 1 wherein the lifting means includes two ammunition round holders mounted on separate arms, means for pivoting the arms with respect to the turret but independently of the gun to lift the ammunition round holders to the second position, wherein one arm and one ammunition round holder lifts rounds from the first section of the magazine and the other arm and ammunition round holder lifts rounds from the second section of the magazine as the arms are operated alternatively.

4. The apparatus in accordance with claim 3 wherein the means for pivoting the arms with respect to the magazine include a separate axis for each arm extending parallel to the plane of elevation of the gun and positioned on opposite sides of the gun.

5. The apparatus in accordance with claim 1 wherein the lifting means includes an ammunition round holder for aligning the individual rounds with the axis of the gun breech and an arm pivoted about a horizontal axis, said horizontal axis extending normal to the plane of elevation of the gun.

6. The apparatus, in accordance with claim 1 wherein the lifting means includes an ammunition round holder for aligning individual rounds with the breech of the gun and parallel arm means pivoted to the ammunition round holder at axially spaced locations thereon and to the armored turret at spaced locations in the space between the sections, the parallel arm means having pairs of arms pivoted to one another for collapsing to pick up rounds and for extending to lift rounds to the breech.

7. Apparatus according to claim 1, wherein said lifting means is movable in the vertical plane of the axis of bore of said gun.

8. Apparatus according to claim 7, wherein said gun includes a pair of mounting trunnions, and wherein said lifting means includes a bent swing arm having a first end for operatively securing thereto a cartridge holder and having a bifurcated second end adapted to be mounted on said pair of trunnions.

9. Apparatus according to claim 1, wherein said lifting means is movable in a plane parallel to the vertical plane of the axis of bore of said gun.

10. Apparatus according to claim 9, wherein said lifting means includes two straight swing arms arranged in a common plane along one longitudinal side of a cartridge holder, each one of said swing arms being pivotally secured to said cartridge holder and in said space.

11. Apparatus according to claim 10, wherein each one of said two swing arms is pivotably secured to pivot shafts extending transverse to said axis of bore of said gun, said pivot shafts including two upper pivot shafts operatively connectible to said cartridge holder and two lower pivot shafts operatively mounted in said space.

* * * * *